US010837434B2

(12) United States Patent
Choi et al.

(10) Patent No.: US 10,837,434 B2
(45) Date of Patent: Nov. 17, 2020

(54) RECIPROCATING COMPRESSOR HAVING A GAS BEARING

(71) Applicant: LG ELECTRONICS INC., Seoul (KR)

(72) Inventors: Kichul Choi, Seoul (KR); Kwangwoon Ahn, Seoul (KR); Donghan Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 286 days.

(21) Appl. No.: 16/031,220

(22) Filed: Jul. 10, 2018

(65) Prior Publication Data

US 2018/0320678 A1 Nov. 8, 2018

Related U.S. Application Data

(63) Continuation of application No. 14/487,346, filed on Sep. 16, 2013, now Pat. No. 10,151,308.

(30) Foreign Application Priority Data

Sep. 16, 2013 (KR) ..... 10-2013-0111291

(51) Int. Cl.
*F04B 39/02* (2006.01)
*F04B 35/04* (2006.01)
(Continued)

(52) U.S. Cl.
CPC ..... *F04B 39/0292* (2013.01); *F04B 35/045* (2013.01); *F04B 39/126* (2013.01); *F04B 39/16* (2013.01); *F04B 53/008* (2013.01)

(58) Field of Classification Search
CPC .. F04B 39/0292; F04B 35/045; F04B 39/126; F04B 53/008; F04B 35/04;
(Continued)

(56) References Cited

U.S. PATENT DOCUMENTS 2,752,001 A 6/1956 Muller
3,894,855 A * 7/1975 Bidol ..... F04B 39/16 55/385.4
(Continued)

FOREIGN PATENT DOCUMENTS

CN 101091043 12/2007
CN 101512154 8/2009
(Continued)

OTHER PUBLICATIONS

Korean Office Action dated Sep. 30, 2019 issued in KR Application No. 10-2013-0111291.
(Continued)

*Primary Examiner* — Patrick Hamo
(74) *Attorney, Agent, or Firm* — KED & Associates LLP

(57) ABSTRACT

A reciprocating compressor is provided. The reciprocating compressor may include a cylinder having a compression space, a piston inserted into the cylinder to define the compression space while being reciprocated, the piston having a suction passage to communicate with the compression space, a gas bearing having at least one bearing hole that passes through the cylinder, so that a refrigerant gas may be injected between the cylinder and the piston to support the piston with respect to the cylinder, and a flow resister disposed at an outer circumferential surface of the cylinder or at one side of the cylinder to restrict a flow of the refrigerant gas flowing through or toward the at least one bearing hole.

17 Claims, 11 Drawing Sheets

(51) Int. Cl.
*F04B 39/12* (2006.01)
*F04B 53/00* (2006.01)
*F04B 39/16* (2006.01)

(58) Field of Classification Search
CPC .. F04B 39/0276; F04B 39/123; F04B 39/122; F04B 39/0005; F04B 39/12
USPC ..... 417/417
See application file for complete search history.

(56) References Cited

U.S. PATENT DOCUMENTS

| | | | | |
|---|---|---|---|---|
| 9,890,779 | B2 * | 2/2018 | Ahn | F04B 39/122 |
| 10,151,308 | B2 * | 12/2018 | Choi | F04B 35/045 |
| 2002/0096479 | A1 * | 7/2002 | Butters | B01D 53/14 210/748.14 |
| 2004/0154468 | A1 * | 8/2004 | Kiikka | F02G 1/0435 92/162 R |
| 2006/0090477 | A1 * | 5/2006 | Rolff | F04B 7/04 62/6 |
| 2008/0008606 | A1 | 1/2008 | Muth et al. | |
| 2008/0118375 | A1 * | 5/2008 | Muth | F02G 1/0435 417/363 |
| 2008/0274020 | A1 * | 11/2008 | Matsuoka | B01D 46/2466 422/180 |
| 2009/0238701 | A1 | 9/2009 | Giacchi et al. | |
| 2010/0046866 | A1 * | 2/2010 | Schubert | F04B 35/045 384/105 |
| 2010/0146922 | A1 | 6/2010 | Greenwood | |
| 2010/0296951 | A1 * | 11/2010 | Lee | F04B 35/045 417/417 |
| 2015/0078925 | A1 * | 3/2015 | Choi | F04B 35/045 417/228 |

FOREIGN PATENT DOCUMENTS

| | | |
|---|---|---|
| CN | 102979697 | 3/2013 |
| EP | 2 568 173 | 3/2013 |
| JP | 2005-264744 | 9/2005 |
| KR | 10-2000-0038309 | 7/2000 |
| KR | 10-2013-0026889 | 3/2013 |
| WO | WO 2013/071382 | 5/2013 |

OTHER PUBLICATIONS

European Search Report dated Feb. 18, 2015 issued in Application No. 14184860.6.
Chinese Search Report dated Mar. 2, 2016 issued in Application No. 2014104702287.
European Patent Office Communication dated Aug. 5, 2016 issued in Application No. 14184860.6.
United States Office Action dated Apr. 5, 2017 issued in U.S. Appl. No. 14/487,346.
United States Final Office Action dated Oct. 11, 2017 issued in U.S. Appl. No. 14/487,346.
United States Office Action dated Mar. 7, 2018 issued in U.S. Appl. No. 14/487,346.
European Search Report dated Jun. 13, 2018.

* cited by examiner

-RELATED ART-

-RELATED ART-

RECIPROCATING COMPRESSOR HAVING A GAS BEARING

CROSS-REFERENCE TO RELATED APPLICATIONS

This application is a Continuation Application of prior U.S. patent application Ser. No. 14/487,346 filed Sep. 16, 2014, which claims priority under 35 U.S.C. § 119 to Korean Application No. 10-2013-0111291 filed Sep. 16, 2013, whose entire disclosures are hereby incorporated by reference.

BACKGROUND

1. Field

A reciprocating compressor, and more particularly, a reciprocating compressor including a gas bearing is disclosed herein.

2. Background

In general reciprocating compressors, a piston suctions and compresses a refrigerant while the piston is linearly reciprocated within a cylinder to discharge the refrigerant. Reciprocating compressors may be classified into connection-type reciprocating compressors and vibration-type reciprocating compressors according to an operation method of the piston.

In such a connection-type reciprocating compressor, a piston is connected to a rotational shaft of the rotation motor through a connecting rod to compress a refrigerant while the piston is reciprocated within a cylinder. On the other hand, in such a vibration-type reciprocating compressor, a piston is connected to a mover of a reciprocating motor to compress a refrigerant while the piston is reciprocated and vibrated within a cylinder. Embodiments disclosed herein relate to the vibration-type reciprocating compressor. Thus, hereinafter, the vibration-type reciprocating compressor will be referred to as a reciprocating compressor.

The reciprocating compressor may be improved in performance when the cylinder and the piston are smoothly lubricated in a state in which they are air-tightly sealed. For this, according to the related art, a lubricant, such as oil, may be supplied between the cylinder and the piston to form an oil film, thereby sealing a space between the cylinder and the piston and also lubricating the cylinder and the piston. However, a separate oil supply to supply the lubricant is necessary. Also, if leakage of the oil occurs according to operation conditions of the compressor, the compressor may be deteriorated in performance. Also, as a space to receive a predetermined amount of oil is needed, the compressor may increase in size. In addition, as an inlet of the oil supply always has to be immersed in the oil, the compressor may be limited as to an installation direction thereof.

In consideration of the limitations of the oil lubrication type reciprocating compressor, as illustrated in FIGS. 1 and 2, a portion of a compression gas may be bypassed between a piston 1 and a cylinder 2 to form a gas bearing between the piston 1 and the cylinder 2. A plurality of bearing holes 2*a*, each of which may have a small diameter and through which the compression gas may be injected, may pass through an inner circumferential surface of the cylinder 2.

According to this technology, a separate oil supply to supply the oil may not be required between the piston 1 and the cylinder 2, simplifying a lubricating structure of the compressor. In addition, leakage of the oil according to the operation conditions may be prevented to uniformly maintain the performance of the compressor. Also, as a space to receive the oil is not required in a casing of the compressor, the compressor may be miniaturized and freely installed in various directions. Reference numeral 3 represents a plate spring, reference numerals 5*a* to 5*c* represent connecting bars, and reference numerals 6*a* and 6*b* represent links.

However, in the reciprocating compressor according to the related art, foreign substances mixed into a refrigerant gas may be introduced into a gas bearing, blocking the gas bearing. As a result, the refrigerant gas may not be supplied between the cylinder 2 and the piston 1, and thus, concentricity between the piston 1 and the cylinder 2 may be twisted, causing friction loss or abrasion while the piston 1 is reciprocated in a state in which the piston is closely attached to the cylinder 2. More particularly, when oil remaining in a refrigeration cycle is mixed with the refrigerant, and then, the mixture is introduced into the gas bearing of the compressor, foreign substances may block the gas bearing due to viscosity of the oil, deteriorating performance of the bearing. Also, when the oil is introduced between the cylinder 2 and the piston 1, the foreign substances mixed with the oil may adhere between the cylinder 2 and the piston 1, causing the friction loss or abrasion.

In consideration of this limitation, a bearing hole for the gas bearing may be increased in size to prevent the bearing hole from being blocked by the foreign substances. However, in this case, the compressed refrigerant gas may not be discharged into the refrigeration cycle, and thus, an amount of refrigerant introduced into the gas bearing may increase, increasing compression loss.

BRIEF DESCRIPTION OF THE DRAWINGS

Embodiments will be described in detail with reference to the following drawings in which like reference numerals refer to like elements, and wherein.

DETAILED DESCRIPTION

Figure 1:
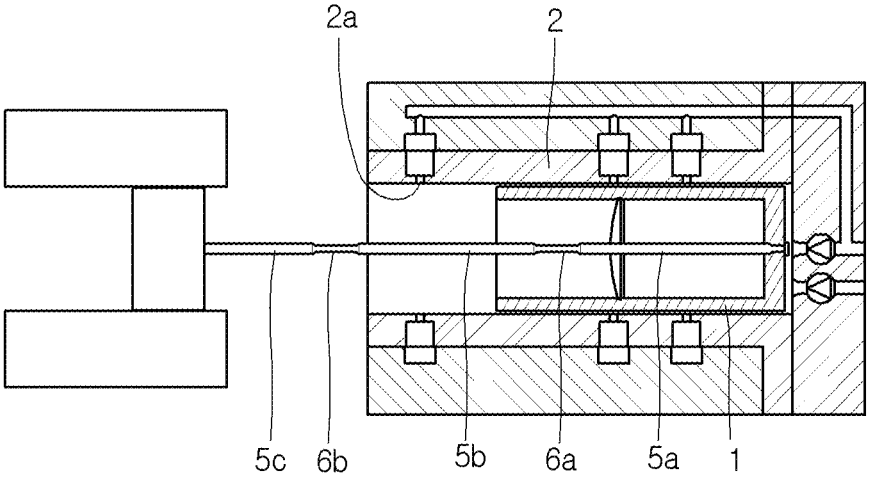
FIG. 1 is a cross-sectional view of a conventional gas bearing applied to a related art reciprocating compressor.
Figure 2:
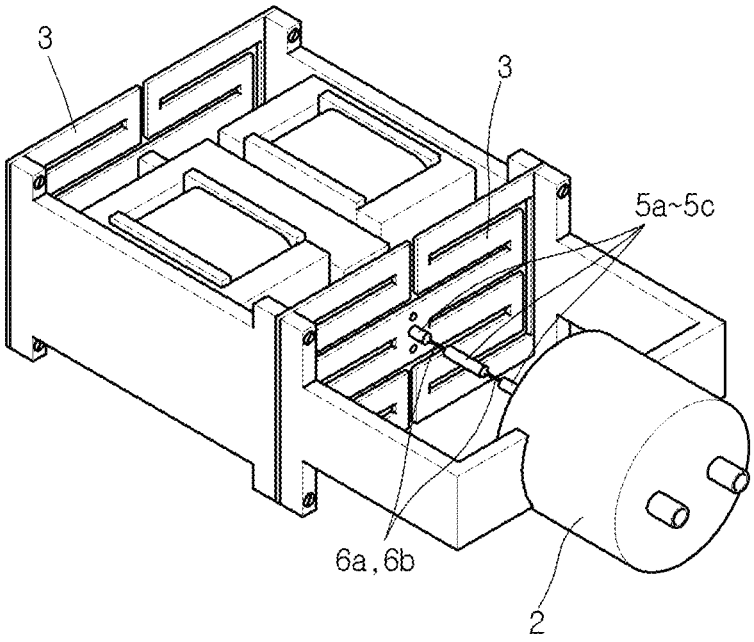
FIG. 2 is a perspective view of a conventional plate spring applied to the related art reciprocating compressor.

Reference will now be made in detail to embodiments, examples of which are illustrated in the accompanying drawings. Where possible, like reference numerals have been used to indicate like elements and repetitive disclosure has been omitted.

Figure 3:
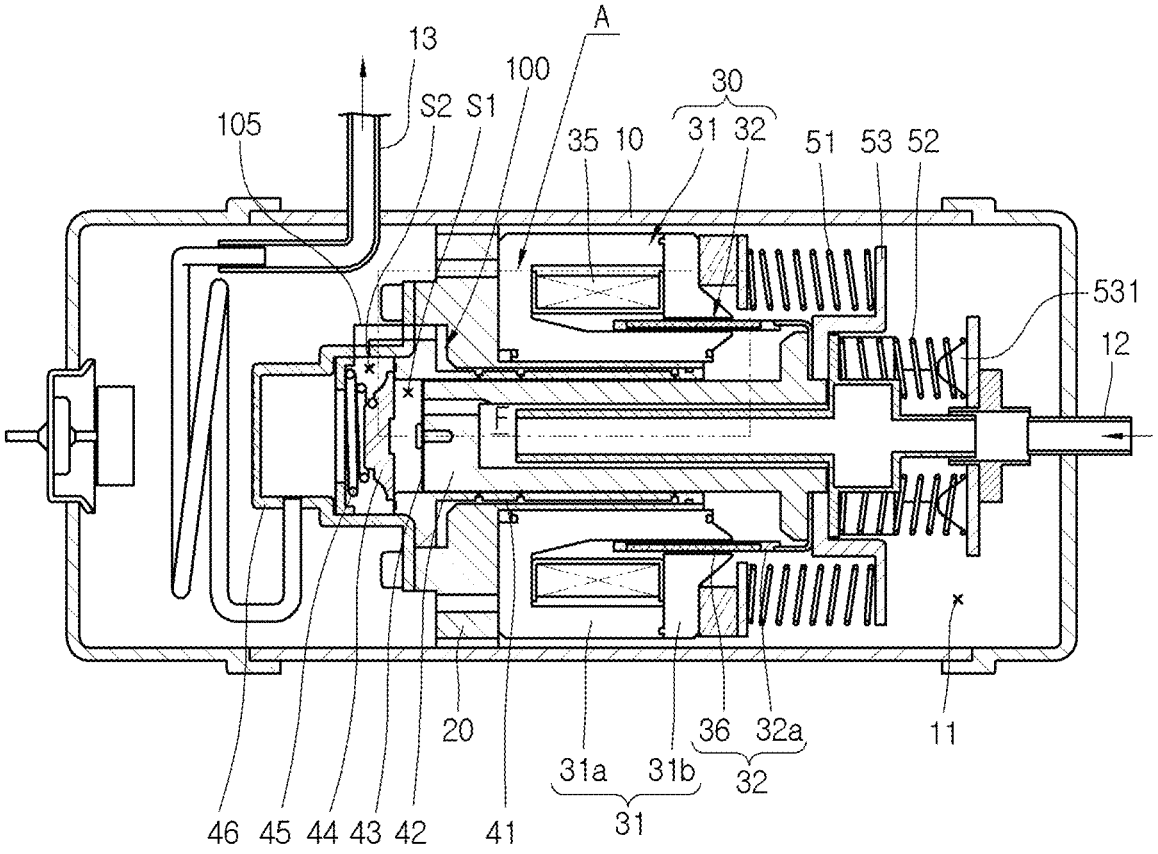
FIG. 3 is a cross-sectional view of a reciprocating compressor according to an embodiment.

FIG. 3 is a cross-sectional view of a reciprocating compressor according to an embodiment. Referring to FIG. 3, in a reciprocating compressor according to an embodiment, a suction tube 12 may be connected to an inner space 11 of a casing 10, and a discharge tube 13 may be connected to a discharge space S2 of a discharge cover 46, which will be described hereinbelow. A frame 20 may be disposed in the inner space 11 of the casing 10, and a stator 31 and a cylinder 41 of a reciprocating motor 30 may be fixed to the frame 20. A piston 42 coupled to a mover 32 of the reciprocating motor 30 may be inserted into and coupled to the cylinder 41 so that the piston 42 is reciprocated. Resonance springs 51 and 52 to guide resonance movement of the piston 42 may be disposed on both sides of the piston 42 in a moving direction of the piston 42, respectively.

Also, a compression space S1 may be defined in the cylinder 41, and a suction passage F may be defined in the piston 42. A suction valve 43 to open/close the suction passage F may be disposed on an end of the suction passage F, and a discharge valve 44 to open/close the compression space S1 of the cylinder 41 may be disposed on a front end of the cylinder 41.

As described above, in the reciprocating compressor according to this embodiment, when power is applied to the reciprocating motor 30, the mover 32 of the reciprocating motor 30 may be reciprocated with respect to the stator 31. Thus, the piston 42 coupled to the mover 32 may be linearly reciprocated within the cylinder 41 to suction and compress a refrigerant, thereby discharging the compressed refrigerant.

In detail, when the piston 42 retreats, the suction valve 43 may be opened to suction the refrigerant of the casing 10 into the compression space S1 through the suction passage F. When the piston 42 advances, the suction valve 43 may be closed to close the suction passage F, thereby compressing the refrigerant of the compression space S1. Also, when the piston 42 further advances, the refrigerant compressed in the compression space S1 may open the discharge valve 44 and then be discharged to move into an external refrigeration cycle. Reference numeral 45 in FIG. 3 is a spring.

In the reciprocating motor 30, a coil 35 may be inserted into and coupled to the stator 31, and an air gap may be defined in or at only one side with respect to the coil 35. A portion of the stator 31, in which the coil 35 may be disposed with respect to the air gap, may be referred to as an "outer stator", and a portion of the stator 31 disposed on or at a side opposite to the outer stator may be referred to as an "inner stator".

A plurality of magnets 36, which may be inserted into the air gap of the stator 31 and reciprocated in the moving direction of the piston 42, may be disposed in the motor 30. The stator 31 may include a plurality of stator blocks 31*a*, and a plurality of pole blocks 31*b*, each of which may be coupled to or at one side of each of the plurality of stator blocks 31*a* to form the air gap (see reference numeral 31*c* of FIG. 4) together with each of the plurality of stator blocks 31*a*.

The plurality of stator blocks 31*a* and the plurality of pole blocks 31*b* may have an arc shape when projected in an axial direction by stacking a plurality of sheets of thin stator cores in layers. The plurality of stator blocks 31*a* may further have a concave groove (⊏) shape when being projected in the axial direction, and the plurality of pole blocks 31*b* may have a rectangular (I) shape when projected in the axial direction.

The "axial direction" or "longitudinal direction" may represent a horizontal direction. A side or direction from the suction tube 12 toward the compression space S1 may be referred to as a front side or direction in the axial direction. A rear side or direction from the compression space S1 toward the suction tube 12 may be referred to as a rear side or direction in the axial direction. Also, a "radial direction" may be a vertical direction in FIG. 3 and may be understood as a direction substantially perpendicular to the axial direction. The above-described directions may be equally applicable throughout this specification.

The mover 32 may include a magnet holder 32*a* having a cylindrical shape, and the plurality of magnets 36 coupled to an outer circumferential surface of the magnet holder 32*a* along a circumferential direction to form a magnetic flux together with the coil 35. The magnet holder 32*a* may be formed of a nonmagnetic material to prevent the magnetic flux from leaking. However, it may not be necessary for the magnetic holder 32*a* to be formed of the nonmagnetic material. The outer circumferential surface of the magnetic holder 32*a* may have a circular shape, so that the plurality of magnets 36 line-contacts and is attached to the outer circumferential surface of the magnetic holder 32*a*. A magnet mount groove (not shown) having a band shape so that the plurality of magnets 36 may be inserted thereinto and supported in a moving direction thereof may be defined in the outer circumferential surface of the magnet holder 32*a*.

Each of the plurality of magnets 36 may have a hexahedral shape, and the plurality of magnets 36 may be attached on the outer circumferential surface of the magnet holder 32*a* piece by piece. Also, when the plurality of magnets 36 is attached piece by piece, a separate fixing ring or support (not shown), such as a taper formed of a composite material may surround the outer circumferential surface of each of the magnets 36 to fix the plurality of magnets 36 to the magnet holder 32.

The plurality of magnets 36 may be sequentially attached to the outer circumferential surface of the magnet holder 32*a* along the circumferential direction. However, as the stator 31 is formed by the plurality of stator blocks 31*a*, and the plurality of stator blocks 31*a* is arranged at a predetermined distance along the circumferential direction, the plurality of magnets 36 may also be attached to the outer circumferential surface of the magnet holder 32*a* at a predetermined distance along the circumferential direction, at a distance between the stator blocks 31*a*. In this case, the number of magnets 36 may be reduced.

A length of each of the plurality of magnets 36 in the moving direction may not be less than a length of the air gap 31*c* in the moving direction. In detail, the length of each of the plurality of magnets 36 in the moving direction may be greater than the length of the air gap 31*c* in the moving direction. An end of one side of the plurality of magnets 36 in at least the moving direction may be disposed within the air gap 31*c* at an initial position or during the operation. In this case, the plurality of magnets 36 may be stably reciprocated. Also, N and S poles of each of the plurality of magnets 36 may correspond to each other in the moving direction.

The stator 31 may have only one air gap 31*c*. In some cases, air gaps (not shown) may be defined in both sides of a longitudinal direction with respect to the coil 35. In this case, the mover 32 may have the same structure as the foregoing embodiment.

The resonance springs 51 and 52 may include first and second resonance springs 51 and 52, which may be, respectively, disposed on both sides in forward and backward directions of a spring support 53 coupled to the mover 32 and the piston 42.

A plurality of the first and second resonance springs 51 and 52 may be provided. Also, each of the plurality of first and second resonance springs 51 and 52 may be arranged in the circumferential direction. Alternatively, only one of the first and second resonance springs 51 and 52 may be provided in plurality, and the other may be provided as only one.

Each of the first and second resonance springs 51 and 52 may include a compression coil spring. Thus, when each of the first and second resonance springs 51 and 52 are expanded and contracted, a side force may occur. The first and second resonance springs 51 and 52 may be arranged to offset the side force or torsion moment thereof.

For example, when two first resonance springs 51 and two second resonance springs 52 are alternately arranged in the circumferential direction, ends of each of the first and second resonance springs 52 may be wound in a counter-clockwise direction at a same position with respect to a center of the piston 42. Also, the resonance springs disposed in a diagonal direction may be symmetrically disposed and arranged to match corners to each other so that the side force and the torsion moment occur in directions opposite to each other.

A spring protrusion 531 may be disposed on a frame or the spring support 53, to which an end of each of the first and second resonance springs 51 and 52 may be press-fitted or fixed. This is done to prevent the resonance springs 51 and 52, which may be arranged to match corners to each other, from rotating.

The first and second resonance springs 51 and 52 may be provided in a same number or numbers different from each other. Also, the first and second resonance springs 51 and 52 may have a same elasticity.

In summary, according to characteristics of the compression coil spring, a side force may occur while a spring is expanded or contracted to twisting the piston 42. However, according to this embodiment, as the plurality of first and second resonance springs 51 and 52 are wound in directions opposite to each other, the side force and torsion moment that are generated in each of the resonance springs 51 and 52 may be offset by the resonance springs disposed in the diagonal direction to maintain an orientation of the piston 42 and prevent surfaces of the resonance springs 51 and 52 from being worn.

Also, as the compression coil spring is slightly deformed in a longitudinal direction without restricting the piston 42 in a transverse direction, the compressor may be installed horizontally or vertically. In addition, as it is unnecessary to connect the mover 32 and the piston 42 to each other through a separate connecting bar or link, manufacturing costs and a number of assembled parts may be reduced.

In the reciprocating compressor as described above, as oil is not provided between the cylinder 41 and the piston 42, when friction loss between the cylinder 41 and the piston 42 is reduced, performance of the compressor may be improved. In this embodiment, a gas bearing, through which a portion of the compression gas may be bypassed between an inner circumferential surface 41*a* of the cylinder 41 and an outer circumferential surface 42*a* of the piston 42 to allow the cylinder 41 and the piston 42 to be lubricated therebetween using a gas force, may be provided.

Figure 4:
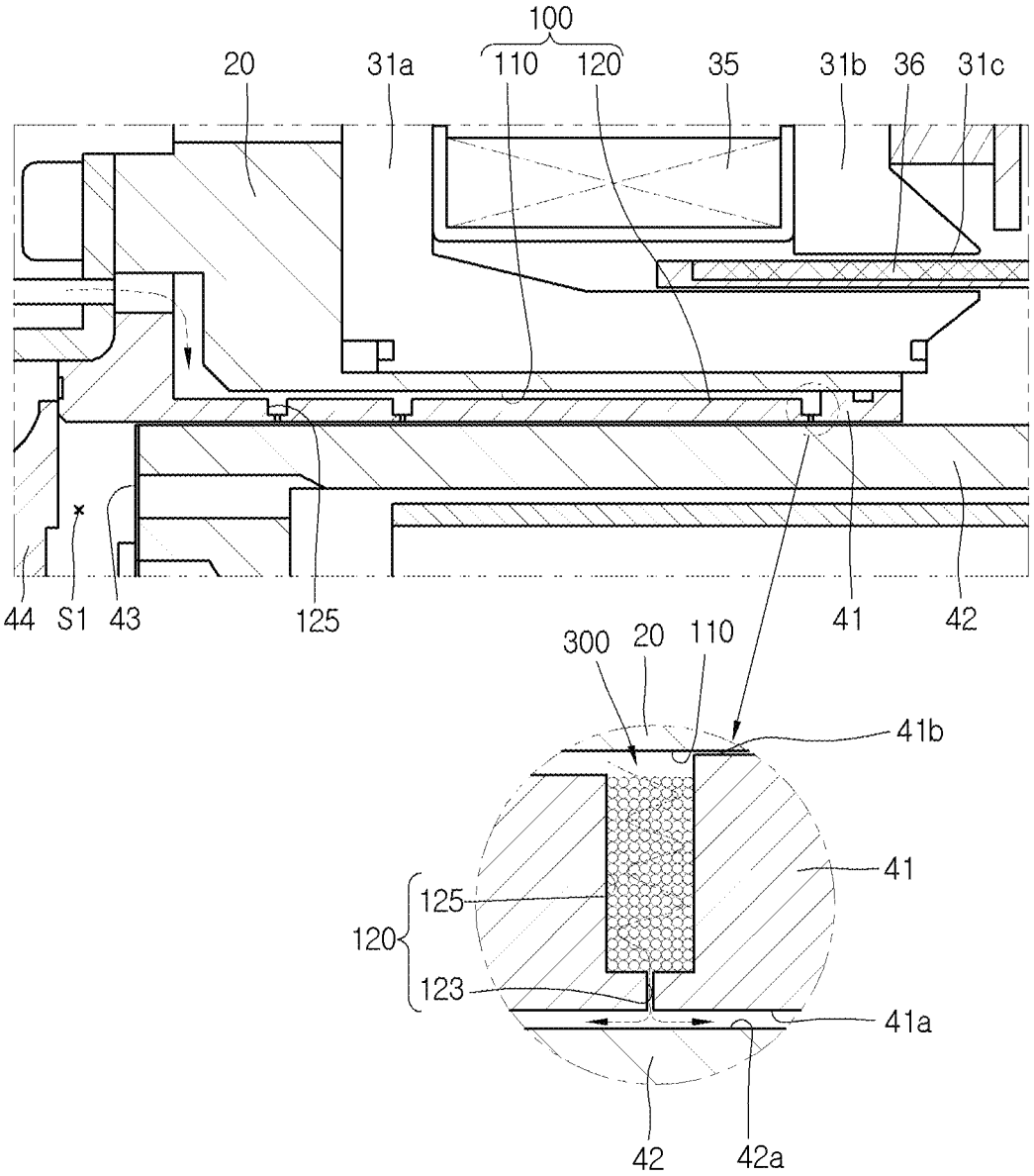
FIG. 4 is an enlarged cross-sectional view illustrating portion A of FIG. 3.

FIG. 4 is an enlarged cross-sectional view illustrating portion A of FIG. 3. That is, FIG. 4 is a cross-sectional view of a gas bearing according to an embodiment.

Referring to FIGS. 3 and 4, the reciprocating compressor according to an embodiment may include a gas bearing 100 for at least a portion of the refrigerant gas discharged through the opened discharge valve 44 into the cylinder 41. The gas bearing 100 may include a gas pocket 110 recessed by a predetermined depth in an inner circumferential surface of the frame 20, a bypass tube 105 that extends from the discharge cover 46 to the gas pocket 110, and a plurality of rows of bearing holes 120 that pass through the inner circumferential surface 41*a* of the cylinder 41. The plurality of rows of the bearing holes 120 may be bearing holes defined in an end of the cylinder 41 in a longitudinal direction, that is, defined in the same circumference.

The gas pocket 110 may have a ring shape on an entire inner circumferential surface of the frame 20. In some cases, a plurality of gas pockets 110 may be provided at a predetermined distance along a circumferential direction of the frame 20.

The gas pocket 110 may be disposed between the frame 20 and the cylinder 41. However, in another embodiment, the gas pocket 110 may be disposed on a front end of the cylinder 41 in the longitudinal direction of the cylinder. In this case, the gas pocket 110 may directly communicate with the discharge space S2 of the discharge cover 46. Thus, as a separate gas guide is not required, the assembling process may be simplified, and also, manufacturing costs may be reduced.

The bypass tube 105 may extend from a first point on the discharge cover 46 to a second point on the discharge cover 46. The first point and the second point may be understood as portions through which at least a portion of the discharge cover 46 may pass to allow the refrigerant to flow. Also, the second point may communicate with the gas pocket 110.

At least a portion of the refrigerant gas may flow from a first point on the discharge cover 46 into the bypass tube 105. Then, the refrigerant gas may flow into the gas pocket 110 via the second point on the discharge cover 46.

In this embodiment, as the piston 42 has a length greater than a length of the cylinder 41 to increase a weight of the piston 42, sagging of the piston 42 may occur due to characteristics of the compression coil spring. Thus, friction loss and abrasion may occur between the piston 42 and the cylinder 41. More particularly, in a case in which oil is not supplied between the cylinder 41 and the piston 42, and gas is supplied to support the piston 42, when the bearing holes 120 are adequately defined, sagging of the piston 41 may be prevented to prevent friction loss and abrasion from occurring between the cylinder 41 and the piston 42.

For example, the plurality of rows of the bearing holes 120 that pass through the inner circumferential surface 41*a* of the cylinder 41 may be defined at a predetermined distance over the entire area in the longitudinal direction of the piston 42. That is, when the piston 42 has the length greater than the length of the cylinder 41 and is reciprocated in an axial direction, the plurality of bearing holes 120 to inject gas between the cylinder 41 and the piston 42 may be uniformly defined in front and rear areas of the piston 42 adjacent to the compression space S1, as well as in a rear area of the piston 42. Thus, the gas bearing 100 may stably support the piston 41 to prevent friction loss and abrasion from occurring between the cylinder 41 and the piston 42.

More particularly, according to characteristics of the compression coil springs 51 and 52, deformation in the transverse direction may be relatively large, causing sagging of the piston 42. However, as the bearing holes 120 are uniformly defined over the entire area in the longitudinal direction of the piston 42, the piston 42 may not sag, and thus, may be smoothly reciprocated to effectively prevent friction loss and abrasion from occurring between the cylinder 41 and the piston 42.

In the reciprocating compressor according to this embodiment, when a total cross-sectional area of the plurality of bearing holes 120 defined in a front portion of the cylinder 41 is greater than a total cross-sectional area of the plurality of bearing holes 120 defined in a rear portion of the cylinder 41, sagging of the piston 42 may be prevented, and thus, occurrence of friction loss and abrasion between the cylinder 41 and the piston 42 may be prevented.

For this, a number of bearing holes defined in the front portion of the cylinder 41 may be greater than a number of bearing holes defined in the rear portion of the cylinder 41, or a cross-sectional area of each of the bearing holes defined in a lower portion may be greater than a cross-sectional area of each of the plurality of bearing holes 120 defined in an upper portion. Also, a number of bearing holes or a cross-sectional area of the bearing holes 120 may gradually increase from a front side of the cylinder 41 toward a rear side to improve a front-side supporting force of the gas bearing 100. For example, FIG. 4 illustrates a structure in which two bearing holes 120 are defined in the front portion of the cylinder 41, and one bearing hole 120 is defined in the rear portion of the cylinder 41.

Also, the plurality of bearing holes 120 may each include a gas guide groove 125 recessed by a predetermined depth from the outer circumferential surface 41*b* of the cylinder 41 to guide the compression gas introduced into the gas pocket 110 toward each of the plurality of bearing holes 120. Each gas guide groove 125 may serve as a buffer for the compression gas. Also, a nozzle 123 that extends from each gas guide groove 125 toward the inner circumferential surface 41*a* of the cylinder 41 may be disposed in each bearing hole 120. The nozzle 123 may be connected to the inner circumferential surface 41*a* of the cylinder 41.

A length of the gas guide groove 125 in a radial direction may be greater than a length of the nozzle 123 in the radial direction. Each gas guide groove 125 may have a diameter greater than a diameter of the nozzle 123.

The gas guide groove 125 may have a ring shape so that the plurality of bearing holes 120 in each row may communicate with each other. Alternatively, the plurality of bearing holes 120 in each row may be independent from each other and be defined at a predetermined distance along the circumferential direction. For example, when the gas guide grooves 125 are defined at a predetermined distance along the circumferential direction so that the gas guide grooves 125 are, respectively, provided in the bearing holes 120, the compression gas may have a uniform pressure, and a strength of the cylinder 41 may be improved.

When the gas bearing 100 is applied as described in this embodiment, if foreign substances mixed in the refrigerant are introduced into the plurality of bearing holes 120, the foreign substances may block the bearing plurality of holes 120, which are fine holes, restricting the smooth introduction of refrigerant between the cylinder 41 and the piston 42. More particularly, when the refrigerant, in which oil may be mixed, is introduced into the gas bearing 100, the foreign substances may block the bearing holes 120 due to a viscosity of the oil, restricting the introduction of the refrigerant gas and increasing abrasion and friction loss between the cylinder 41 and the piston 42. Thus, it may be important to reliability of the compressor to prevent the oil or foreign substances from being introduced into the gas bearing 100.

In consideration of the above-described structure, each bearing hole 120 may be reduced in cross-sectional area to prevent the foreign substances from being introduced into the bearing hole 120. However, if the bearing hole 120 is too small in size, the possibility of the blocking of the bearing hole 120 due to foreign substances may increase. On the other hand, although the bearing hole 120 may increase in cross-sectional area to prevent the foreign substances from blocking the bearing hole 120, a larger amount of gas refrigerant may be introduced into the gas bearing 120, increasing compression loss, thereby reducing compressor efficiency.

Thus, in this embodiment, the bearing hole 120 may be provided in an adequate size, and a flow resister may be disposed on an inlet-side of the bearing hole 120 to prevent the oil or foreign substances from being introduced into the bearing hole 120 and also to prevent the compression gas from being excessively introduced, thereby improving compressor performance.

Figure 5:
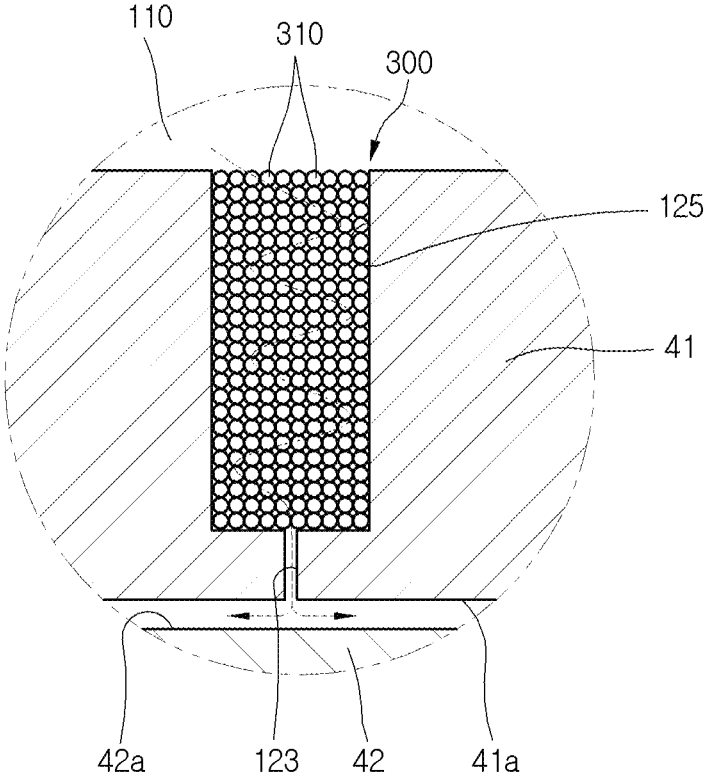
FIGS. 5 to 7 are cross-sectional views illustrating examples of a flow resister of FIG. 4.
Figure 6:
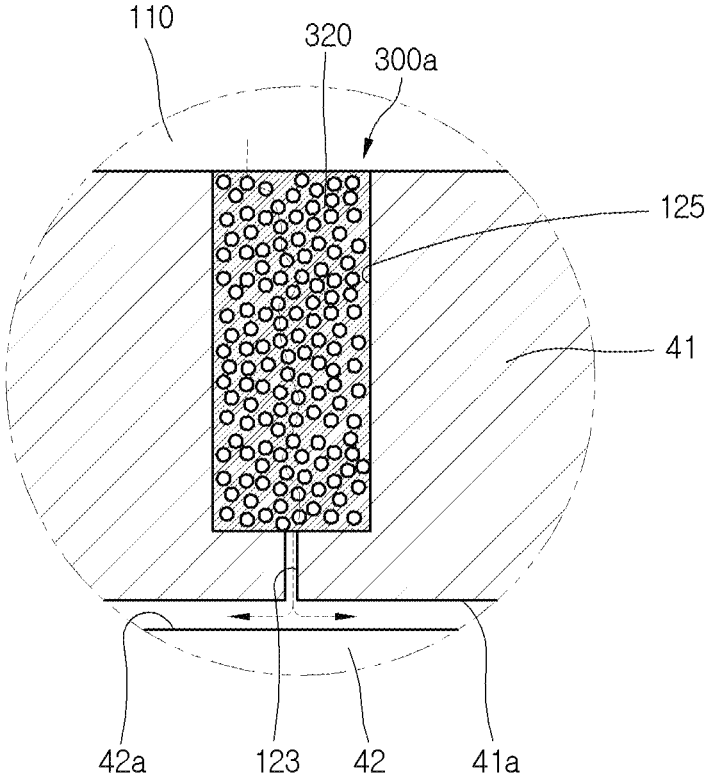
Figure 7:
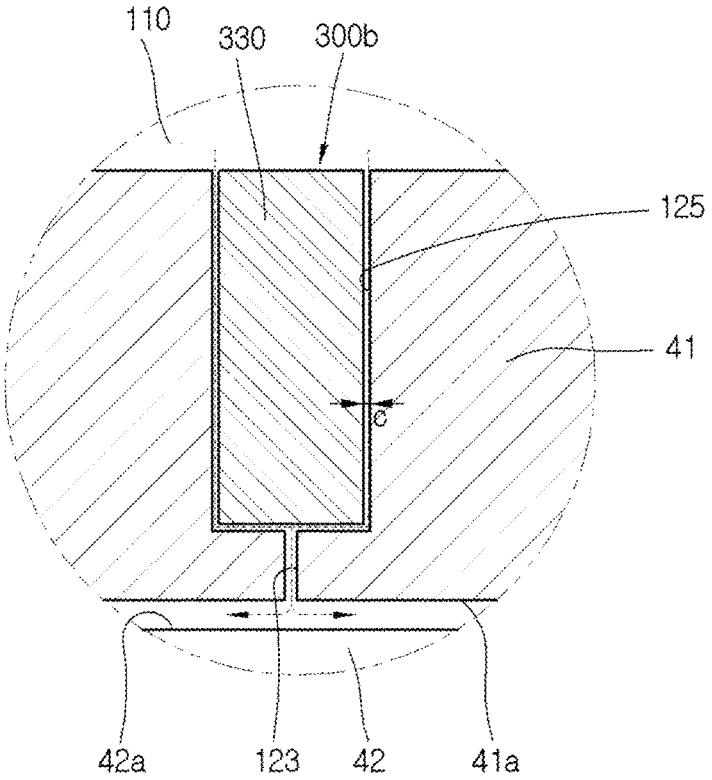
Figure 8:
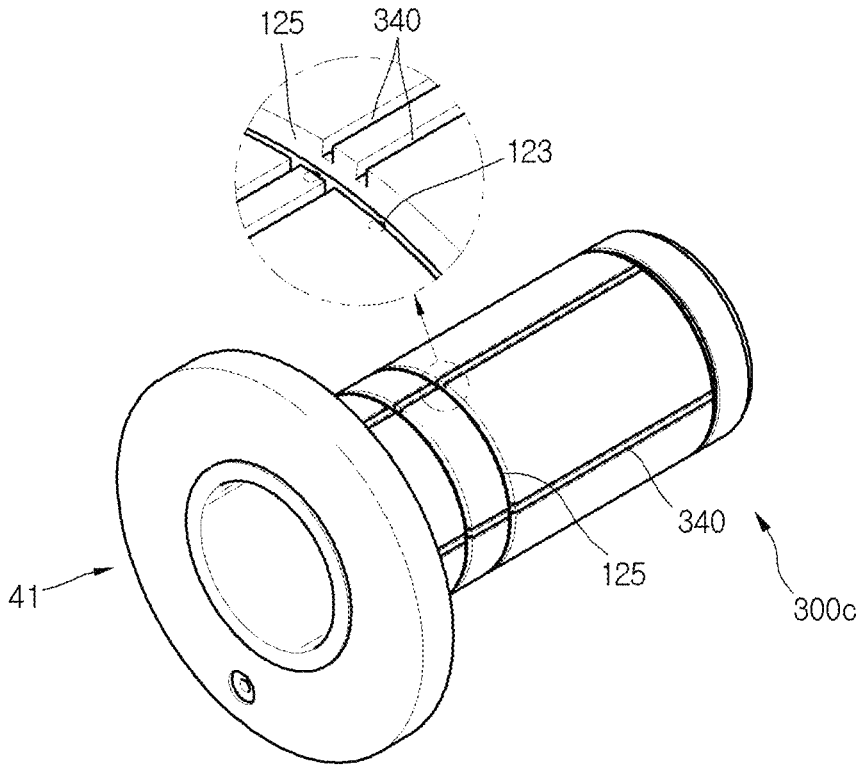
FIG. 8 is a perspective view of a cylinder illustrated for explaining a modified example of the flow resister of FIG. 4.

FIGS. 5 to 7 are cross-sectional views illustrating examples of a flow resister of FIG. 4. FIG. 8 is a perspective view of a cylinder illustrated for explaining a modified example of the flow resister of FIG. 4.

A flow resister 300 may be disposed in gas guide groove 125 according to an embodiment. As illustrated in FIG. 5, the flow resister 300 may include a fine wire 310 that is wound several times in the gas guide groove 125. The fine wire 310 may be a fabric wire having a high filtering effect. As another example, the fine wire 310 may include a metal member. The fine wire 310 may have a cross-sectional area equal to or less than a cross sectional area of the nozzle 123 so that the fine wire 310 does not fully cover the nozzle 123.

As another example, as illustrated in FIG. 6, flow resister 300*a* may include a plurality of porous members 320 having a plurality of fine vents. Each of the plurality of fine vents of the plurality of porous members 320 may have a cross-sectional area less than the cross-sectional area of the nozzle 123. Thus, oil or foreign substances may be effectively filtered to prevent the nozzle 123 from being blocked.

As another example, as illustrated in FIG. 7, the flow resister 300*b* may include a block 330 disposed to be spaced apart from an inner circumferential surface of the gas guide groove 125. The block 330 may have a cross-sectional area less than a cross-sectional area of the gas guide groove 125. Thus, the compression gas may pass through a gap C between the block 330 and the gas guide groove 125, and then, may be introduced into the nozzle 123.

When the flow resister 300*a*, 300*b* is provided as the plurality of porous members 320 or the block 330, the flow resister 300*a*, 300*b* may be applied to the gas guide groove 125 having a circular band shape. Alternatively, the flow resister 300, 300*a*, 300*b* may also be provided to the gas guide groove 125 having a groove shape and independently defined in each of the plurality of bearing holes 123.

As another example, as illustrated in FIG. 8, the flow resister 300*c* may include a gas dispersion groove 340 defined in the outer circumferential surface 41*b* of the cylinder 41 to communicate with the gas guide groove 125. The gas dispersion groove 340 may be formed by recessing at least a portion of the outer circumferential surface 41*b* of the cylinder 41 to extend in a direction to cross the gas guide groove 125. For example, the gas dispersion groove 340 may extend in forward and backward directions of the outer circumferential surface 41*b* of the cylinder 41.

At least a portion of the refrigerant gas introduced into the bearing hole 120 may flow into the gas dispersion groove 340, and then, may be dispersed. Thus, it may prevent the refrigerant gas from be excessively introduced into the nozzle 123 or prevent the oil or foreign substances from being introduced into the nozzle 123.

The gas dispersion groove 340 may have a cross-sectional area greater than the cross-sectional area of the nozzle 123 and less than or equal to the cross-sectional area of the gas guide groove 125. In this case, the refrigerant gas introduced into the gas guide groove 125 may be dispersed into the gas dispersion groove 340 having the relatively larger cross-sectional area than the nozzle 123 having the relatively smaller cross-sectional area. As a result, even though the nozzle 123 has a cross-sectional area greater than a predetermined area, as the refrigerant gas may not be introduced into the nozzle 123, but rather, may be guided into the gas dispersion groove 340, blocking of the bearing hole 120 may be previously prevented.

Figure 9:
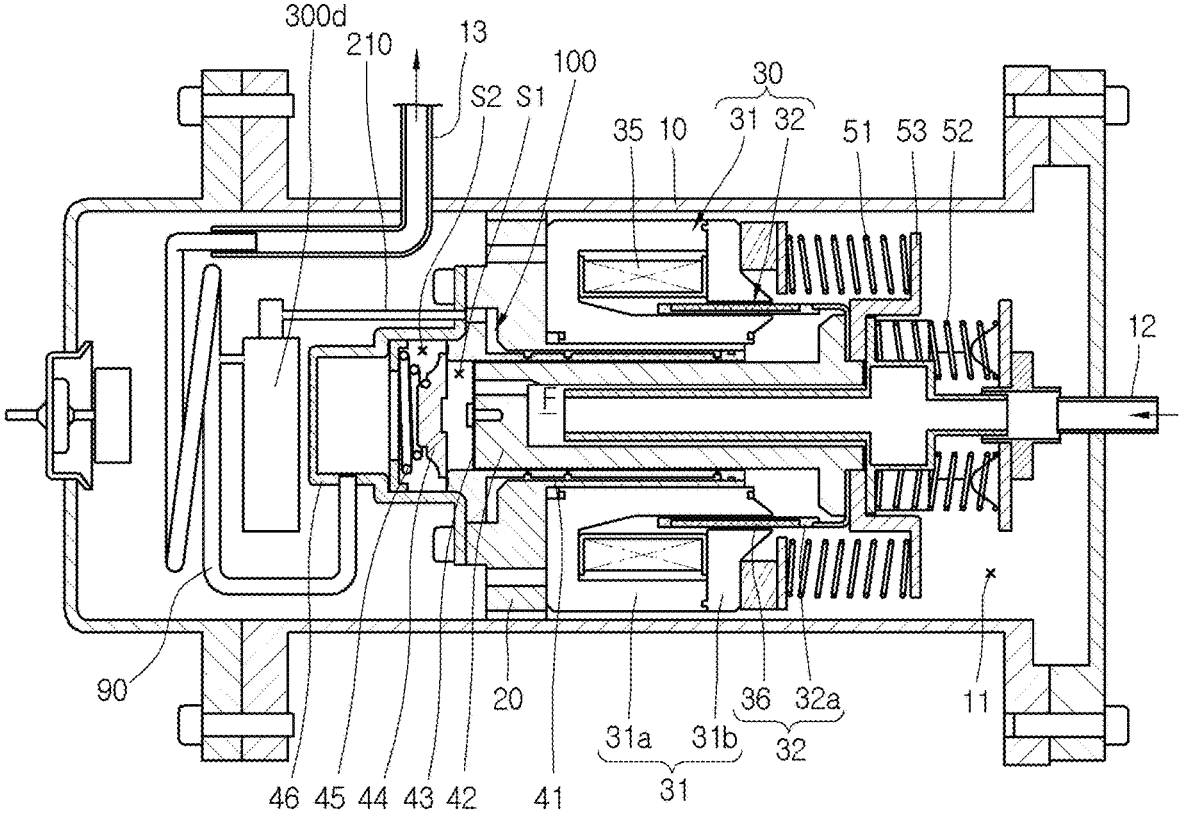
FIG. 9 is a cross-sectional view of a reciprocating compressor that is illustrated for explaining a modified example of the flow resister in the reciprocating compressor of FIG. 3.
Figure 10:
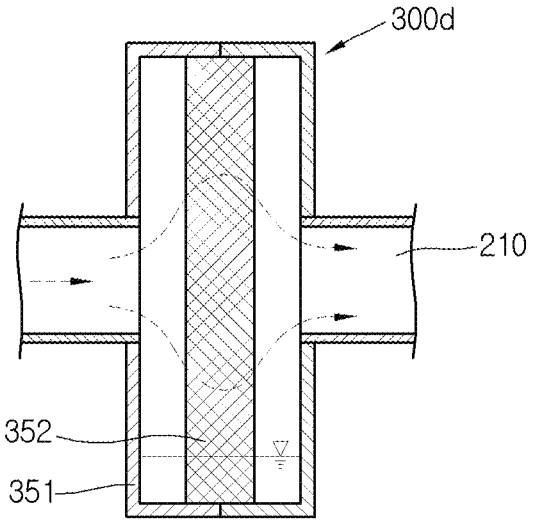
FIG. 10 is a cross-sectional view illustrating an inside of the flow resister of FIG. 9.

As another example, A flow resister may be disposed in an intermediate portion of a gas guide tube to connect the discharge space S2 to the gas pocket 110. FIG. 9 is a cross-sectional view of a reciprocating compressor that is illustrated for explaining a modified example of the flow resister in the reciprocating compressor of FIG. 3. FIG. 10 is a cross-sectional view illustrating an inside of the flow resister of FIG. 9.

Referring to FIGS. 9 and 10, a reciprocating compressor according to this embodiment may include flow resister 300*d*, into which at least a portion of a refrigerant gas discharged through discharge valve 44 may be introduced, and gas guide tube 210 connected to the flow resister 300*d* to guide the refrigerant gas into gas pocket 110.

In detail, the flow resister 300*d* may be connected to discharge pipe 90, which may be connected to discharge cover 46 to guide discharge of a refrigerant. The discharge pipe 90 may be connected to discharge tube 13.

The gas guide tube 210 may have a length greater than a predetermined length, so that the refrigerant gas introduced into the gas pocket 110 through the gas guide tube 210 may be heat-exchanged with a low-temperature suction refrigerant, which may be filled into inner space 11 of casing 10, and thus, may be cooled and decompressed. For example, the gas guide tube 210 may extend from a filter housing 351 of the flow resister 300*d* to the discharge cover 46 to communicate with gas bearing 100. The refrigerant may be introduced into the gas bearing 100, that is, the gas pocket 110 via portions through which the gas guide tube 210 and the discharge cover 46 pass.

As another example, the gas guide tube 210 may be directly connected to discharge space S2 of the discharge cover 46, which may be coupled to a front end of cylinder 41 to extend to the gas bearing 100.

The flow resister 300*d* may include the filter housing 351 and a filter 352 disposed within the filter housing 351 to filer oil or foreign substances. The filter housing 351 may be connected to the discharge pipe 90 through a predetermined tube.

The filter 352 may be provided as an adsorbent filter, such as activated carbon, which is capable of adsorbing the oil. Alternatively, the filter 352 may be provided as a cyclone filter to filter and collect the oil or the foreign substances, such as metal pieces, using a centrifugal effect and a membrane filter using a filtering effect.

As described above, when the flow resister 300*d* is disposed between the discharge space S2 and the gas pocket 110, a portion of the compressed refrigerant gas may be introduced into the filter housing 351 via the discharge pipe 90 or directly introduced into the filter housing 351 to pass through the filter 352. In this process, the foreign substances and oil may be filtered by the filter 352 to prevent the foreign substances or oil from being introduced into the gas bearing 100.

Thus, blocking of the bearing hole 120, which is a fine hole, by the foreign substances may be prevented to allow the gas bearing 120 to smoothly operate and stably support the cylinder 41 and piston 42. In addition, the filter housing 351 may serve as a kind of silencer and reduce a pressure pulse of the discharged refrigerant to reduce discharge noise of the compressor.

Also, as the gas guide tube 210 may be disposed outside the discharge cover 46, and the gas guide tube 210 may have a relatively long length, the compression gas introduced into the gas pocket 110 of the gas bearing 120 may be cooled by the low-temperature suction refrigerant which is filled into inner space 11 of the casing 10 to cool the cylinder 41 forming the gas pocket 110, thereby reducing a specific value of the compression space to improve compressor efficiency.

Figure 11:
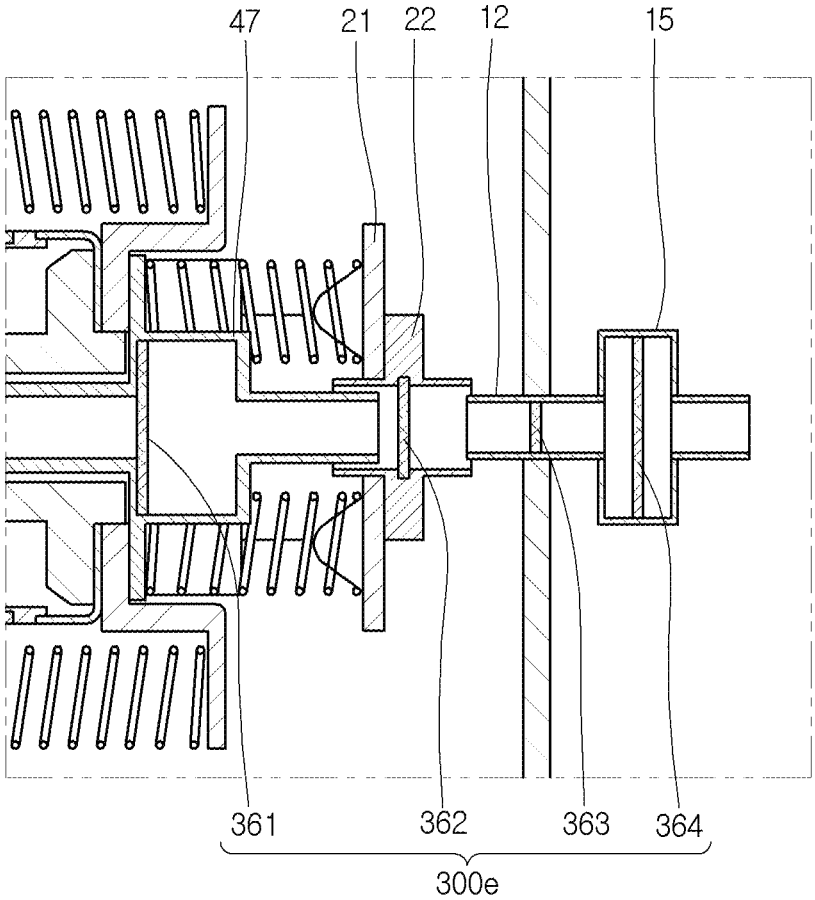
FIG. 11 is a cross-sectional view illustrating a modified example of the flow resister of FIG. 9.

FIG. 11 is a cross-sectional view illustrating a modified example of the flow resister of FIG. 9. As illustrated in FIG. 11, flow resister 300*e* according to this embodiment may be disposed on a suction-side of a compressor.

Filters 361 to 364 may be disposed within suction muffler 47 coupled to an inlet end of suction passage F of piston 42, disposed within an intermediate tube 22 coupled to a back cover 21, disposed within suction tube 12 coupled to casing 10, or disposed within a suction muffler 15 coupled to the casing 10. The back cover 21 may be understood as a cover member that supports a rear portion of second resonance spring 52.

The filters 361 to 364 may include an adsorption filter, a cyclone filter, and/or a membrane filter. Also, although the flow resister 300*e* is disposed on the suction-side in this embodiment, operation effects may be similar to those according to the previous embodiments. However, in this embodiment, as the flow resister 300*e* is disposed on the suction-side of the compression space, foreign substances may be filtered before refrigerant is suctioned into a compression space to prevent cylinder 41 and piston 42 from be worn by the foreign substances. As in the previous embodiments, where the cylinder 41 is inserted into stator 31 of reciprocating motor 30, or the reciprocating motor 30 is mechanically coupled to a compression device including the cylinder 41 at a predetermined distance, a position of bearing hole 120 may be equally applicable to this embodiment. Thus, detailed descriptions thereof have been omitted.

Also, in the previous embodiments, the piston 42 may be reciprocated, and resonance springs 45, 51, 52 may be disposed on each of both sides of the piston 42 in the moving direction thereof. In some cases, the cylinder 41 may be reciprocated, and the resonance springs 45, 51, 52 may be disposed on each of both sides of the cylinder 41. In this case, the bearing holes 120 may be arranged as described in the previous embodiments. Thus, detailed descriptions thereof have been omitted.

In the reciprocating compressor according to embodiments, as the flow resister may be disposed on an inlet-side of the bearing hole, the bearing hole may have an adequate size, and also, introduction of oil or foreign substances into the bearing hole may be prevented to allow compression gas in an adequate amount to serve as the bearing, improving compression performance.

Also, as the gas guide tube is separated from the discharge cover and disposed in the inner space of the casing, high-temperature refrigerant gas discharged into the compression space may be heat-exchanged with suction refrigerant filled in the inner space of the casing, and thus, may be cooled. Thus, the cylinder forming the gas pocket may be cooled to reduce a specific volume of the compression space, thereby improving compressor performance. Also, as vibration or noise generated while the refrigerant is discharged into the compression space may be offset in the gas guide, vibration or noise of the compressor may be reduced.

Embodiments disclosed herein provide a reciprocating compressor in which introduction of foreign substances mixed with a refrigerant gas into a gas bearing may be prevented to prevent friction loss or abrasion between a cylinder and a piston from increasing due to blocking of the gas bearing by the foreign substances.

Embodiments disclosed herein also provide a reciprocating compressor in which introduction of oil circulating into a refrigeration cycle into a gas bearing may be prevented to prevent the gas bearing from being blocked and to reduce friction loss and abrasion between a cylinder and a piston.

Embodiments disclosed herein also provide a reciprocating compressor in which a hole for a gas bearing may be adequately maintained in size to prevent the gas bearing from being blocked by foreign substances and prevent a refrigerant gas from being excessively introduced into the gas bearing, thereby reducing compression loss due to the gas bearing.

Embodiments disclosed herein provide a reciprocating compressor that may include a cylinder having a compression space; a piston inserted into the cylinder to define the compression space while being reciprocated, the piston having a suction passage to communicate with the compression space; a gas bearing having a bearing hole that passes through the cylinder, so that a refrigerant gas is injected between the cylinder and the piston to support the piston with respect to the cylinder; and a flow resistance part or resister disposed on an outer circumferential surface of the cylinder or one side of the cylinder to restrict a flow of the refrigerant gas flowing toward or within the bearing hole.

The bearing hole may include a gas guide groove recessed from the outer circumferential surface of the cylinder; and a nozzle part or nozzle that extends from the gas guide groove toward an inner circumferential surface of the cylinder. The gas guide groove may have a cross-sectional area greater than a cross-sectional area of the nozzle part.

The flow resistance part may be disposed in the gas guide groove. The flow resistance part may include a fine wire that is wound several times in the bearing hole. The fine wire may include a fabric wire. The fine wire may have a cross-sectional area less than or equal to a cross-sectional area of the nozzle part.

The flow resistance part may include one block spaced apart from an inner circumferential surface of the gas guide groove and having a preset or predetermined cross-sectional area, and the refrigerant gas may flow through a gap that is defined between the block and the gas guide groove.

The flow resistance part may include a porous member having a plurality of vents. Each of the vents may have a cross-sectional area less than a cross-sectional area of the nozzle part.

The flow resistance part may include a gas dispersion groove that communicates with the gas guide groove to disperse a portion of the refrigerant gas and recessed by a preset or predetermined depth in the outer circumferential surface of the cylinder, and the gas dispersion groove may extend in a direction that crosses the extension direction of the gas guide groove. The gas dispersion groove may have a cross-sectional area greater than a cross-sectional area of the nozzle part and less than or equal to a cross-sectional area of the gas guide groove.

The flow resistance part may include at least one of an activated carbon, a centrifuge, or a membrane, which may be disposed in a passage through which the refrigerant gas may flow.

The reciprocating compressor may further include a discharge cover coupled to the cylinder, the discharge cover having a discharge space (S2) for the refrigerant gas, and a discharge pipe coupled to the discharge cover to guide discharge of the refrigerant gas. The flow resistance part may include a filter housing connected to the discharge pipe, and a filter disposed within the filter housing. The reciprocating compressor may further include a gas guide tube that extends from the filter housing of the flow resistance part to the discharge cover.

The reciprocating compressor may further include a casing; a suction tube coupled to the casing; and a suction muffler disposed within the casing. The suction muffler may be coupled to an inlet-side of the suction passage of the piston, and the flow resistance part may include a filter disposed in the suction tube or the suction muffler.

Embodiments disclosed herein further provide a reciprocating compressor that may include a casing having an inner space that communicates with a suction tube; a frame disposed in the inner space of the casing; a reciprocating motor coupled to the frame, the reciprocating motor including a mover that is linearly reciprocated; a cylinder coupled to the frame, the cylinder having a compression space; a piston inserted into the cylinder and reciprocated, the piston having a suction passage that passes in a longitudinal direction thereof to guide a refrigerant into the compression space; a gas bearing having a bearing hole that passes through the cylinder so that a refrigerant gas may be injected between the cylinder and the piston to support the piston with respect to the cylinder; and a filter disposed in the bearing hole to prevent foreign substances from being introduced into the cylinder.

The bearing hole may include a gas guide groove in which the filter may be disposed, and a nozzle part or nozzle that extends inward from the gas guide groove in a radial direction. The nozzle part may have a cross-sectional area less than a cross-sectioned area of the gas guide groove.

The filter may be formed by winding a fine wire including a fabric wire several times. The filter may include a porous member. The filter may include one block having a cross-sectional area less than a cross-sectioned area of the bearing hole.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A reciprocating compressor, comprising:

a cylinder;

a piston inserted into the cylinder to define a space for compression, the piston having a suction passage configured to communicate with the space; and a bearing having at least one bearing hole passing through the cylinder to allow a refrigerant to be injected between the cylinder and the piston, wherein a flow resister is disposed on a side of the cylinder, the flow resister being configured to restrict a flow of the refrigerant flowing toward or in the at least one bearing hole, wherein the at least one bearing hole includes a guide groove on an outer circumferential surface of the cylinder in a circumferential direction, and a plurality of nozzles that extends from the guide groove to an inner circumferential surface of the cylinder, wherein the guide groove has a greater cross-sectional area than a cross-sectional area of the plurality of nozzles, and wherein the guide groove is formed in a ring shape, and an inner circumferential surface of the guide groove is formed in a circular shape.

2. The reciprocating compressor according to claim 1, wherein the flow resister is disposed in the guide groove.

3. The reciprocating compressor according to claim 1, wherein the flow resister includes a wire that is wound multiple times in the guide groove.

4. The reciprocating compressor according to claim 3, wherein the wire is a fabric wire.

5. The reciprocating compressor according to claim 3, wherein the wire has a cross-sectional area less than or equal to the cross-sectional area of the plurality of nozzles.

6. The reciprocating compressor according to claim 2, wherein the flow includes an insert spaced apart from the inner circumferential surface of the guide groove and having a predetermined cross-sectional area, and a gap formed between the insert and the guide groove allows the refrigerant to flow to the plurality of nozzles.

7. The reciprocating compressor according to claim 2, wherein the flow resister includes a porous member having a plurality of openings, and wherein each of the plurality of openings has a cross-sectional area less than the cross-sectional area of the plurality of nozzles.

8. The reciprocating compressor according to claim 2, wherein the flow resister includes a dispersion groove communicating with the guide groove and configured to disperse a portion of the refrigerant, wherein the dispersion groove is recessed by a predetermined depth in the outer circumferential surface of the cylinder, and wherein the dispersion groove extends in a direction to cross an extension direction of the guide groove.

9. The reciprocating compressor according to claim 8, wherein the dispersion groove has a cross-sectional area greater than the cross-sectional area of the plurality of nozzles and less than or equal to the cross-sectional area of the guide groove.

10. The reciprocating compressor according to claim 1, wherein the flow resister includes at least one of an activated carbon, a centrifuge, or a membrane disposed in a passage through which the refrigerant flows.

11. The reciprocating compressor according to claim 1, further comprising:

a discharge cover coupled to the cylinder, the discharge cover providing a discharge space for the refrigerant; and a discharge pipe coupled to the discharge cover and configured to guide a discharge of the refrigerant, wherein the flow resister disposed on the side of the cylinder includes:

a filter housing connected to the discharge pipe; and a filter disposed within the filter housing.

12. The reciprocating compressor according to claim 11, further comprising a guide tube that extends from the filter housing to the bearing.

13. The reciprocating compressor according to claim 1, further comprising:

a casing;

a suction tube coupled to the casing; and a suction muffler disposed within the casing, the suction muffler being coupled to an inlet-side of the suction passage of the piston, wherein the flow resister disposed on the side of the cylinder includes at least one filter disposed in at least one of the suction tube or the suction muffler.

14. The reciprocating compressor according to claim 1, further comprising a frame, wherein the cylinder is fixed to the frame.

15. The reciprocating compressor according to claim 14, wherein the bearing further includes a gas pocket recessed by a predetermined depth in an inner circumferential surface of the frame, and wherein the gas pocket communicates with the at least one bearing hole.

16. The reciprocating compressor according to claim 15, wherein the discharge cover includes a bypass pipe that communicates with the gas pocket, and wherein a portion of the refrigerant from the discharge space flows to the gas pocket through the bypass pipe.

17. The reciprocating compressor according to claim 14, further comprising a reciprocating motor including a stator fixed to the frame and a mover coupled to the piston.

* * * * *